US005980645A

United States Patent [19]

Price

[11] Patent Number: 5,980,645

[45] Date of Patent: Nov. 9, 1999

[54] PIPELINE PROCESSING ASSEMBLY

[76] Inventor: Benjamin W. Price, P.O. Box 1681, Marion, N.C. 28752

[21] Appl. No.: 08/884,578

[22] Filed: Jun. 27, 1997

[51] Int. Cl.[6] ..... B08B 9/04

[52] U.S. Cl. ..... 134/8; 134/21; 15/3.51; 15/104.061

[58] Field of Search ..... 15/3.5, 3.51, 104.061, 15/104.062; 134/6, 8, 21; 137/240, 244

[56] References Cited

U.S. PATENT DOCUMENTS

| | | | |
|---|---|---|---|
| 3,135,278 | 6/1964 | Foord | 15/104.061 |
| 3,665,954 | 5/1972 | McNeal et al. | 15/104.061 |
| 3,682,186 | 8/1972 | Howe | 134/8 |
| 3,827,282 | 8/1974 | Brister . | |
| 3,908,682 | 9/1975 | Thompson | 15/104.061 |
| 4,350,202 | 9/1982 | Schulz et al. | 15/3.51 |
| 4,389,461 | 6/1983 | Scott . | |
| 4,416,703 | 11/1983 | Scott | 15/104.061 |
| 5,186,757 | 2/1993 | Abney, Sr. . | |
| 5,442,826 | 8/1995 | Murata et al. | 15/3.51 |
| 5,444,886 | 8/1995 | Takashima et al. | 15/3.51 |

OTHER PUBLICATIONS

Huber, Ed (Senior Editor); "Special pigging cleans salt–laden gas pipeline"; Hart's Pipeline Digest; Nov. 1996; p. 48; Hart Publications, Inc.; U.S.A.

*Primary Examiner*—Terrence R. Till
*Attorney, Agent, or Firm*—Adams Law Firm, P.A.

[57] ABSTRACT

A pipeline processing assembly for a pipeline adapted to convey a fluid from an upstream end of the pipeline to a downstream end of the pipeline. The assembly includes a pipeline pig for removing earthen matter and other debris from inside the pipeline. The pig is inserted into the pipeline at the upstream end, and has a dimension substantially equal to an inside diameter of the pipeline to form a seal between the pig and the pipeline. A vacuum source communicates with the pipeline downstream of the pig, and generates a reduced air pressure sufficient for moving the pig downstream through the pipeline. The pig gathers and moves the earthen matter and debris downstream through the pipeline and outwardly through an exit opening formed at the downstream end.

13 Claims, 4 Drawing Sheets

PIPELINE PROCESSING ASSEMBLY

TECHNICAL FIELD AND BACKGROUND OF THE INVENTION

This invention relates to a pipeline processing assembly and method for cleaning, dewatering, and drying a pipeline to ready the pipeline for conveying fluids, such as liquids and gases. During pipeline construction, unwanted dirt and debris often enters the pipeline as the pipeline is laid in sections. In the past, pipeline pigs have been used in combination with an air compressor connected to the upstream end of the pipeline, and generating increased air pressure on the upstream side of the pigs to move the pigs through the pipeline. The pigs collect the dirt and debris, and move it downstream to an exit opening in the pipeline for discharge to the atmosphere. Movement of the pigs through the pipeline is often slowed, and in many cases stopped, as a result of obstructions such as earthen matter and air blocks forming in the pipeline.

The present invention provides an assembly which generates increased pressure for urging the pigs downstream through the pipeline. In addition, the invention provides an assembly for drying the pipeline in an effective and efficient manner using a vacuum source communicating with the downstream end of the pipeline, and a heater located adjacent an open upstream end of the pipeline. Once the pipeline is laid and buried, the invention cleans the pipeline, dewaters the pipeline after testing, and then drys the pipeline in final preparation for conveying fluid.

SUMMARY OF THE INVENTION

Therefore, it is an object of the invention to provide a pipeline processing assembly used for cleaning, dewatering, and drying a pipeline.

It is another object of the invention to provide a pipeline processing assembly which is applicable for processing any size and length of pipeline.

It is another object of the invention to provide a method of cleaning, dewatering, and drying a pipeline.

These and other objects of the present invention are achieved in the preferred embodiments disclosed below by providing a pipeline processing assembly for a pipeline adapted to convey a fluid from an upstream end of the pipeline to a downstream end of the pipeline. The assembly includes a pipeline pig for removing earthen matter and other debris from inside the pipeline. The pig is inserted into the pipeline at the upstream end, and has a dimension substantially equal to an inside diameter of the pipeline to form a seal between the pig and the pipeline. A vacuum source communicates with the pipeline downstream of the pig, and generates a reduced air pressure sufficient for moving the pig downstream through the pipeline. The pig gathers and moves the earthen matter and debris downstream through the pipeline and outwardly through an exit opening formed at the downstream end.

According to one preferred embodiment of the invention, a filter assembly is located at the downstream end of the pipeline and upstream of the vacuum source for capturing the earthen matter and debris exiting the pipeline.

According to another preferred embodiment of the invention, the filter assembly includes a perforated, axially-extending filter pipe connected to the exit opening of the pipeline.

According to yet another preferred embodiment of the invention, the filter assembly further includes a filter tank communicating with the vacuum source and surrounding the filter pipe for collecting the earthen matter and debris passing through the filter pipe.

According to yet another preferred embodiment of the invention, the filter tank is substantially filled with a liquid, and the filter pipe is submerged therein.

According to yet another preferred embodiment of the invention, a clean-out opening is formed in the filter tank for cleaning out the earthen matter and debris collecting in the filter tank.

According to yet another preferred embodiment of the invention, a bypass line is connected at its first end to the pipeline upstream of the exit opening, and connected at its second end to a connecting line joining the filter assembly and pipeline. The bypass line is opened upon movement of the pig to the downstream end of the pipeline to remove any earthen matter and debris remaining in the pipeline upstream of the pig.

According to yet another preferred embodiment of the invention, an exhaust line is located downstream of the vacuum source for exhausting air passing through the pipeline and filter assembly.

In another embodiment, the pipeline processing assembly includes a pipeline pig for removing earthen matter and other debris from inside the pipeline. The pig is inserted into the pipeline at the upstream end of the pipeline, and has a dimension substantially equal to an inside diameter of the pipeline to form a seal between the pig and the pipeline. Moving means are provided for moving the pig downstream through the pipeline to an exit opening formed at the downstream end of the pipeline. A filter assembly is located at the exit opening for capturing the earthen matter and debris exiting the pipeline.

In yet another embodiment, the pipeline processing assembly includes a pipeline pig for being inserted into the pipeline at the upstream end, and having a dimension substantially equal to an inside diameter of the pipeline to form a seal between the pig and the pipeline. Moving means are provided for moving the pig downstream through the pipeline to urge the fluid contained in the pipeline outwardly through an exit opening formed at the downstream end of the pipeline. A vacuum source is adapted for communicating with the pipeline upon formation of an air block upstream of the exit opening and downstream of the pig. The vacuum source generates a reduced air pressure sufficient for absorbing the air block through the fluid to free downstream movement of the pig, thereby draining of the fluid from the pipeline.

According to another preferred embodiment of the invention, a holding tank is connected to the exit opening of the pipeline and communicates with the vacuum source for receiving the fluid exiting the pipeline as the vacuum source absorbs the air block to free downstream movement of the pig.

In yet another embodiment, the pipeline processing assembly includes a heat source which communicates with the upstream end of the pipeline and generates a heated gas. The heat source is introduced into the pipeline after the fluid is drained from the pipeline. A vacuum source communicates with the downstream end of the pipeline, and cooperates with the heat source for drawing the heated gas through the pipeline from the upstream end to the downstream end to dry an interior of the pipeline.

According to yet another preferred embodiment of the invention, a canopy cover surrounds the heat source to prevent substantial escape of the heated gas to the atmosphere.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
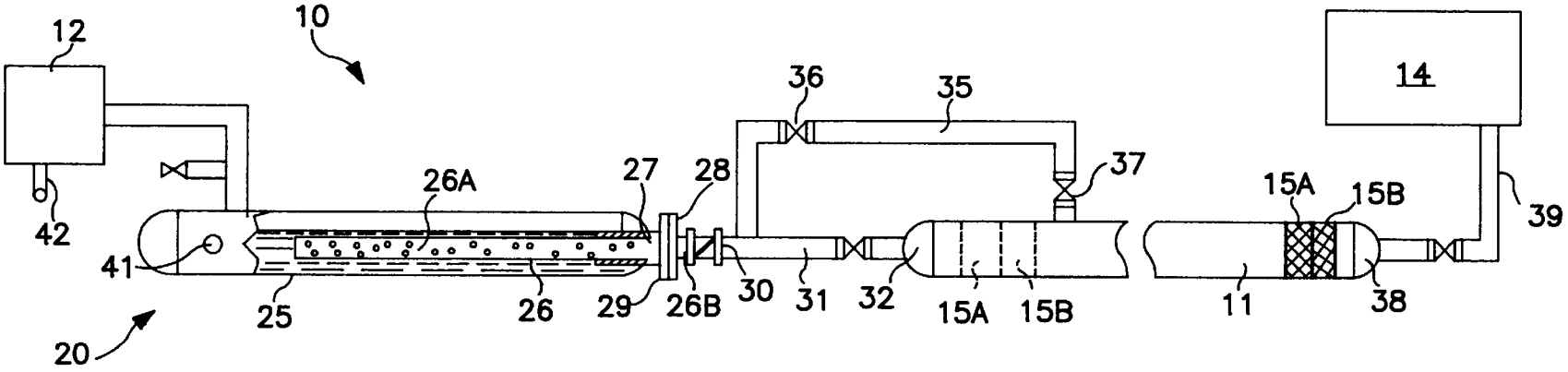
FIG. 1 is a schematic view the pipeline processing assembly according to one preferred embodiment of the invention, and showing the invention as used for removing earthen matter and other debris contained in the pipeline after the pipeline is laid in sections and prior to conveying a fluid.

Referring now specifically to the drawings, a pipeline processing assembly according to one embodiment of the present invention is illustrated in FIG. 1 and shown generally at reference numeral 10. The assembly 10 is particularly applicable for removing earthen matter and debris from inside the pipeline 11 after the pipeline 11 is laid in sections and prior to conveying fluids, such as water. Other applications of invention are discussed further below.

The assembly 10 includes a vacuum pump 12 and, preferably, an air compressor 14 which are connected at opposite ends of the pipeline 11, and which cooperate to force one or more pipeline cleaning pigs 15A, 15B through the pipeline 11 from an upstream end of the pipeline 11 to a downstream end of the pipeline 11. The vacuum pump 12 supplies greater than 90 percent of the force for moving the pigs 15A, 15B downstream through the pipeline 11, and in an alternative embodiment, is used alone without the compressor 14 and with the upstream end of the pipeline 11 open to the atmosphere. The vacuum pressure supplied by the pump for a 20 mile length of 6"-diameter pipe is preferably about 25–30" Hg. The compressor 14 is intended to maintain increased pressure on the upstream side of the pigs 15A, 15B as the vacuum pump 12 generates reduced pressure on the downstream side of the pigs 15A, 15B. The pressure supplied by the compressor is about 25–50 psi.

Each pig 15A, 15B has a dimension substantially equal to or slightly greater than the inside diameter of the pipeline 11 in order to form a seal between the pig and the pipeline. The strength of the seal is sufficient to maintain reduced air pressure on the downstream side of the pig. The pigs 15A, 15B preferably run together through the pipeline 11 directly adjacent to each other. According to one embodiment, the lead pig 15A is a wire pig used for scraping the interior of the pipeline 11, and the trailing pig 15B is a polymeric foam pig.

The vacuum pump 12 is connected through flexible hose 18 to a filter assembly 20 including a filter tank 25 filled with a liquid, such as water, and a removable filter pipe 26. The filter pipe 26 has a closed-ended perforated section 26A for being inserted into the tank 25 and an open-ended non-perforated section 26B extending outside the tank 25. According to one embodiment, the filter tank 25 is approximately 12 feet long and has a diameter of about 24 inches. The filter pipe 26 has a diameter of about 6 inches, and extends along the length of the tank 25 about 2–4 inches above the tank bottom. The water level in the tank 25 is preferably maintained at a point no less than about 12 inches from the top of the tank 25, such that the perforated section 26A of the filter pipe 26 remains entirely submerged during operation of the assembly 10.

Figure 2:
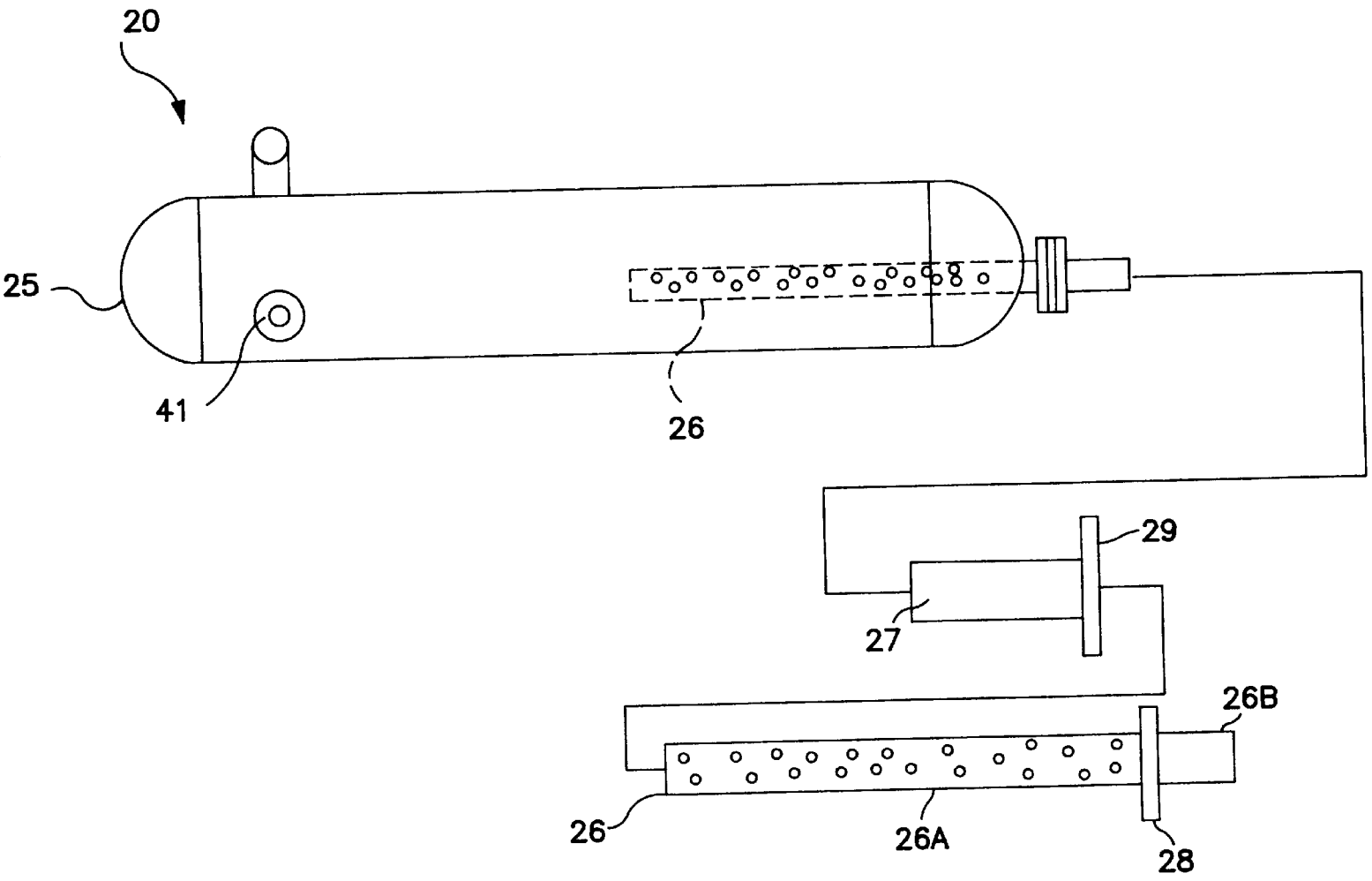
FIG. 2 is an exploded view of the filter assembly showing the filter pipe and mounting sleeve removed from the filter tank.

As best shown in FIG. 2, the filter pipe 26 is supported by an elongate mounting sleeve 27 welded to the tank 25, and having a diameter slightly larger than the diameter of the filter pipe 26 to allow manual insertion and removal of the filter pipe 26 into and from the tank 25. A slip-on annular flange 28 separates the perforated and non-perforated sections of the filter pipe 26, and resides against an annular end flange 29 of the mounting sleeve 27 upon insertion of the pipe 26 into the tank 25. A standard reducer (not shown) is placed between the flanges 28 and 29 to effect the seal between the filter pipe 26 and tank 25. A check valve 30 prevents water from exiting the tank 25 through the filter pipe.

The non-perforated section 26B of the filter pipe 26 extending outside the tank 25 is connected to a connecting pipe 31 which leads to a weld cap 32 covering the downstream end of the pipeline 11. An exit opening (not shown) is formed in the weld cap 32 to allow fluid connection of the pipe 31 and the pipeline 11. A by-pass line 35 including valves 36 and 37 connects at one end to the connecting pipe 31, and at a second end to the pipeline 11 upstream of the weld cap 32. The upstream end of the pipeline 11 is closed by weld cap 38 and includes an entrance opening (not shown) which communicates through flexible hose 39 with the air compressor 14.

Operation of the Pipeline Processing Assembly 10

The pigs 15A, 15B are inserted at the upstream end of the pipeline 11, as indicated above, using any conventional pig loading method. One such method is described in U.S. Pat. No. 5,186,757 incorporated by reference herein. The vacuum pump 12 and compressor 14 cooperate to move the pigs 15A, 15B downstream through the pipeline 11. As the pigs 15A, 15B scrape the interior of the pipeline 11 and move any loose dirt and debris collecting in the pipeline 11 to the exit opening at the downstream end of the pipeline 11. From the exit opening, the dirt and debris is suctioned through the connecting pipe 31 and into the filter pipe 26. The water in the filter tank 25 helps break up any relatively large debris, and pass it outwardly from the filter pipe 26 to the filter tank 25. The filter tank 25 is periodically drained through a clean-out opening 41, and the filter pipe 26 removed and cleaned to avoid clogging the perforations.

Filtered air is drawn by the vacuum pump 12 through the tank 25 and flexible hose 18, and exhausted outwardly into the atmosphere through an exhaust line 42. When the pigs 15A, 15B reach the downstream end of the pipeline 11, by-pass valves 36 and 37 are opened and any dirt and debris remaining inside the pipeline 11 is suctioned through the by-pass line 35, through the filter pipe 26 and filter tank 25, as described above, and outwardly through the exhaust line 42. Because of the high efficiency of the present assembly 10, this process sufficiently cleans the pipeline 11 in a single pass, but may be repeated if desired.

Assembly 50 for Breaking Air Blocks

Figure 3:
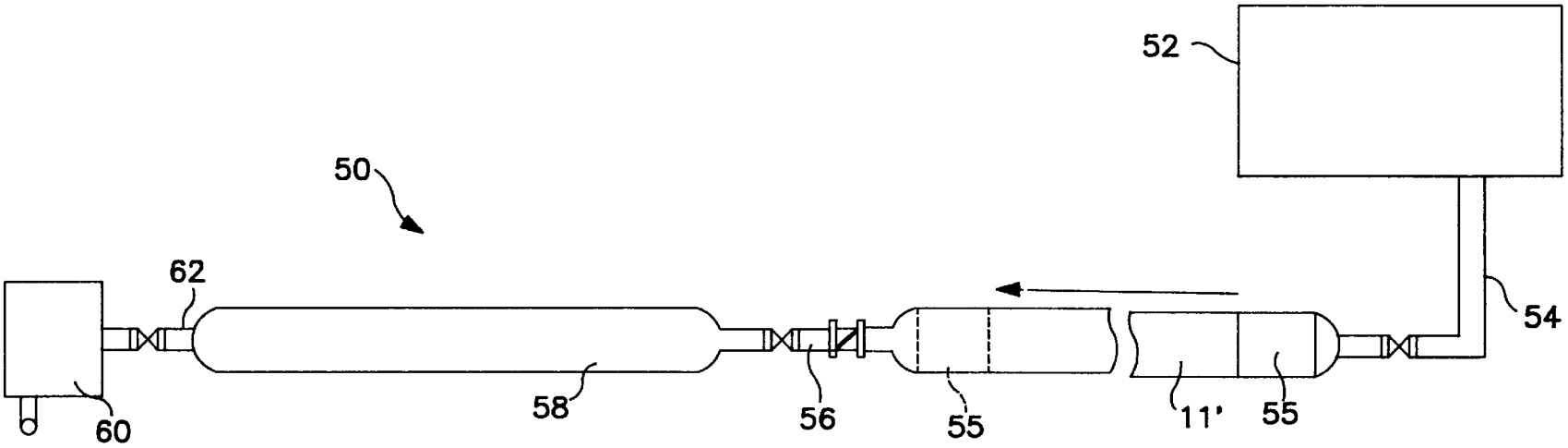
FIG. 3 is a schematic view of the pipeline processing assembly according to a second preferred embodiment of the invention, and showing the invention as used for breaking air blocks forming in the pipeline when draining the pipeline.

After cleaning, the pipeline 11' is generally tested by filling the line with water under pressure to ensure proper operation of all valves and seals. When testing is complete, the pipeline 11' is dewatered in preparation for receiving and conveying fluid. The assembly 50, shown in FIG. 3, is applicable for breaking air blocks formed in the pipeline 11' during this process.

The assembly 50 includes an air compressor 52 connected to an upstream end of the pipeline 11' through flexible hose 54, and generating increased air pressure for moving a pig 55 downstream through the pipeline 11' from its upstream end to its downstream end. The pig 55 used in this assembly 50 is preferably a conventional polymeric foam pig. The pig 55 moves the water in the pipeline 11' downstream and outwardly through an exit opening (not shown) to a discharge area.

During this dewatering process, pockets of air often form between the pig 55 and the exit opening of the pipeline 51. These air pockets block downstream movement of the pig 55 and must be absorbed in order to completely dewater the pipeline 11'.

In case of an air block, a pipe section 56 of the present assembly is connected to the exit opening of the pipeline 11' to re-direct water flow from the discharge area into a holding tank 58. A vacuum pump 60 is connected though flexible hose 62 to the holding tank 58, and generates a reduced air pressure sufficient for absorbing the air pockets through the pipeline 11' and holding tank 58. Once the air pockets are broken, the pig 55 continues its downstream movement through the pipeline 11'. The pipe section 56 is disconnected and the water is again drained to the discharge area. The pressure supplied by the vacuum pump 60 for a 20 mile length of 6" diameter pipe is about 25–28" Hg. The capacity of the holding tank 58 is preferably about 30,000–40,000 gal.

Assembly for Drying the Pipeline

Figure 4:
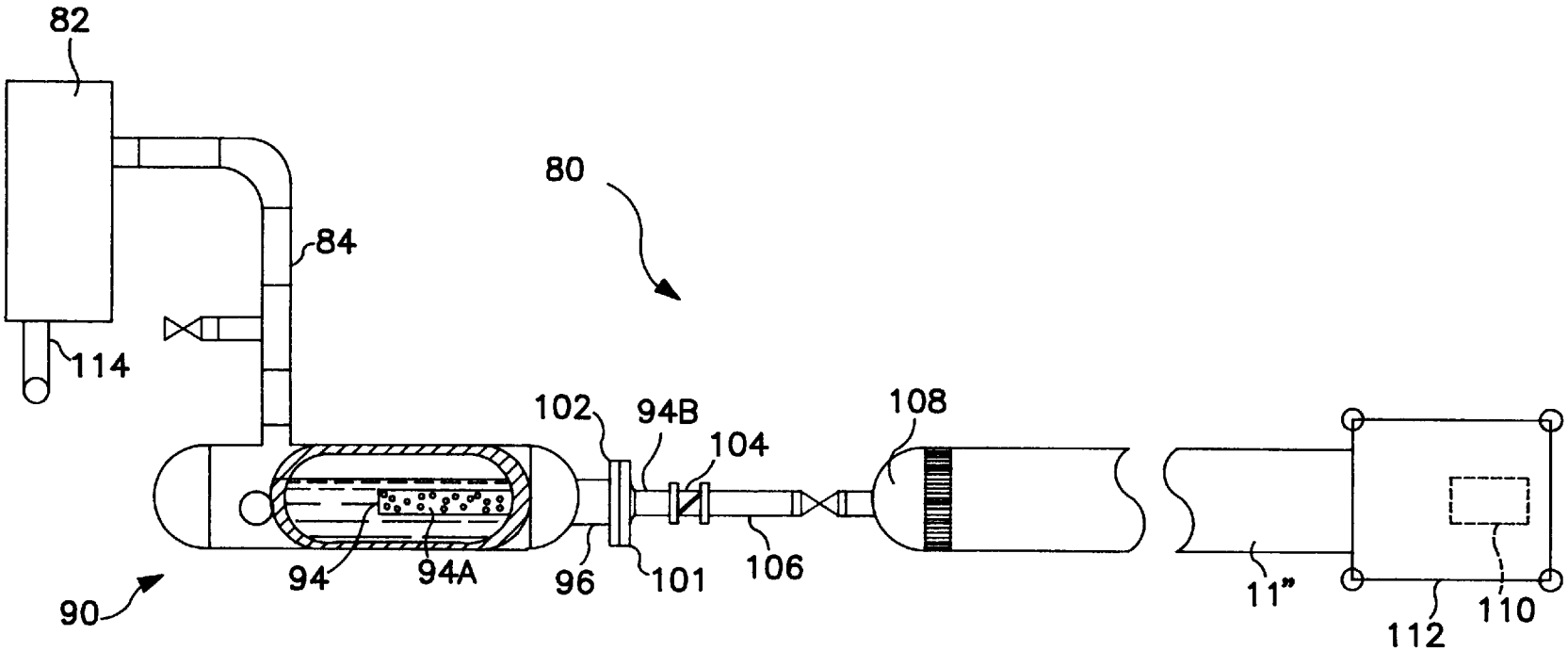
FIG. 4 is a schematic view of the pipeline processing assembly according to a third preferred embodiment of the invention, and showing the invention as used for drying the interior of the pipeline after draining the fluid from the pipeline.

After cleaning, testing and dewatering, the interior of the pipeline 11" is preferably dried prior to receiving and conveying fluid. A further application of the present invention for drying the pipeline 11" is shown in FIG. 4.

The assembly 80 includes a vacuum pump 82 connected to the pipeline 11", as described above, and supplying a reduced air pressure sufficient for moving one or more drying pigs (not shown) downstream through the pipeline 11" from an upstream end of the pipeline to a downstream end of the pipeline. The vacuum pressure supplied by the pump 82 for a 20 mile length of 6"-diameter pipe is preferably about 25–30" Hg. The upstream end of the pipeline 11" is open to the atmosphere.

The drying pig has a dimension substantially equal to or slightly greater than the inside diameter of the pipeline 11" in order to form a seal between the pig and the pipeline. The pig is preferably formed of a compressible polymeric foam.

The vacuum pump 82 is connected through flexible hose 84 to a filter assembly 90 including a filter tank 92 filled with water and a removable filter pipe 94. The filter assembly 90 is preferably identical to the filter assembly 20 described above. The filter pipe 94 has a closed-ended perforated section 94A for being inserted into the tank 92 and an open-ended non-perforated section 94B extending outside the tank 92. The water level in the tank 92 is preferably maintained such that the perforated section 94A of the filter pipe 94 remains entirely submerged during operation of the assembly 80.

The filter pipe 94 is supported by an elongate mounting sleeve 96 welded to the tank 92, and having a diameter slightly larger than the diameter of the filter pipe 94 to allow manual insertion and removal of the filter pipe 94 into and from the tank 92. A slip-on annular flange 101 separates the perforated and non-perforated sections of the filter pipe 94, and resides against an annular end flange 102 of the mounting sleeve 96 upon insertion of the pipe 94 into the tank 92. A standard reducer (not shown) is placed between the flanges 101 and 102 to effect the seal between the filter pipe 94 and tank 92. A check valve 104 prevents water from exiting the tank 92 through the filter pipe 94.

The non-perforated section 94B of the filter pipe 94 extending outside the tank 92 is connected to a connecting pipe 106 which leads to a weld cap 108 covering the downstream end of the pipeline 11". An exit opening (not shown) is formed in the weld cap 108 to allow fluid connection between the pipe 106 and the pipeline 11".

A conventional industrial heater 110 is located adjacent the open upstream end of the pipeline 11", and is activated after the drying pigs are run through and removed from the pipeline 11". A canopy cover 112 preferably surrounds the top of the heater 110.

Operation of the Assembly 80

One or more drying pigs (not shown) are inserted into the pipeline 11" at the upstream end and moved downstream through the pipeline 11", as previously described. The pigs are removed upon reaching the downstream end of the pipeline 11".

After removing the pigs, the heater 110 is activated at the open upstream end of the pipeline 11". Heated air is drawn into and through the pipeline 11" by the vacuum pump 82. Any remaining water, dirt or debris in the pipeline 11" is passed through the filter assembly 90, as described above, and separated from the air flow exiting the assembly through the hose 84 and an exhaust line 114. The canopy cover 112 prevents substantial escape of heated air into the atmosphere. After drying, the pipeline 11" is fully processed and ready for receiving and conveying fluid.

A pipeline processing assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A pipeline processing assembly for a pipeline adapted to convey a fluid therethrough from an upstream end of the pipeline to a downstream end of the pipeline, comprising:

(a) a pipeline pig for removing earthen matter and other debris from inside the pipeline, said pig being inserted into the pipeline at the upstream end thereof and having a dimension substantially equal to the diameter of an inside wall of the pipeline to form a seal between the pig and the inside wall of the pipeline; and (b) a vacuum source communicating with the pipeline downstream of said pig and generating a reduced air pressure sufficient for moving said pig downstream through the pipeline, whereby the pig gathers and moves earthen matter and debris downstream through the pipeline and outwardly through an exit opening formed at the downstream end thereof;

(c) a filter assembly located at the exit opening of said pipeline for capturing earthen matter and debris exiting the pipeline.

2. A pipeline processing assembly according to claim 1, wherein said filter assembly comprises a perforated, axially-extending filter pipe connected to the exit opening of the pipeline.

3. A pipeline processing assembly according to claim 2, wherein said filter assembly further comprises a filter tank communicating with the vacuum source and surrounding the filter pipe for collecting the earthen matter and debris passing through the filter pipe.

4. A pipeline processing assembly according to claim 3, wherein said filter tank is substantially filled with a liquid, and wherein said filter pipe is submerged therein.

5. A pipeline processing assembly according to claim 4, and including a clean-out opening formed in the filter tank for cleaning out the earthen matter and debris collecting in the filter tank.

6. A pipeline processing assembly according to claim 1, and comprising a bypass line connected at one end thereof to the pipeline upstream of the exit opening, and connected at a second end thereof to a connecting line joining the filter assembly and pipeline, said bypass line being opened upon movement of the pig to the downstream end of the pipeline to remove any earthen matter and debris remaining in the pipeline upstream of the pig.

7. A pipeline processing assembly according to claim 1, and comprising an exhaust line downstream of the vacuum source for exhausting air passing through the pipeline and filter assembly.

8. A pipeline processing assembly for a pipeline adapted to convey a fluid therethrough from an upstream end of the pipeline to a downstream end of the pipeline, comprising:

(a) a pipeline pig for removing earthen matter and other debris from inside the pipeline, said pig being inserted into the pipeline at the upstream end thereof and having a dimension substantially equal to the diameter of an inside wall of the pipeline to form a seal between the pig and the inside wall of the pipeline;

(b) moving means for moving said pig downstream through the pipeline to an exit opening formed at the downstream end of the pipeline; and (c) a filter assembly located at the exit opening for capturing the earthen matter and debris exiting the pipeline, said filter assembly comprising a perforated, axially-extending filter pipe connected to the exit opening of the pipeline.

9. A pipeline processing assembly according to claim 8, wherein said filter assembly further comprises a filter tank communicating with the vacuum source and surrounding the filter pipe for collecting the earthen matter and debris passing through the filter pipe.

10. A pipeline processing assembly according to claim 9, wherein said filter tank is substantially filled with a liquid, and wherein said filter pipe is submerged therein.

11. A pipeline processing assembly according to claim 10, and including a clean-out opening formed in the filter tank for cleaning out the earthen matter and debris collecting in the filter tank.

12. A pipeline processing assembly for a pipeline adapted to convey a fluid therethrough from an upstream end of the pipeline to a downstream end of the pipeline, comprising:

(a) a pipeline pig for being inserted into the pipeline at the upstream end thereof, and having a dimension substantially equal to the diameter of an inside wall of the pipeline to form a seal between the pig and the inside wall of the pipeline;

(b) moving means for moving said pig downstream through the pipeline to urge the fluid contained in the pipeline outwardly through an exit opening formed at the downstream end of the pipeline; and (c) a vacuum source adapted for communicating with the pipeline upon formation of an air block upstream of said exit opening and downstream of said pig, said vacuum source generating a reduced air pressure sufficient for absorbing the air block through the fluid to free downstream movement of said pig, thereby draining of the fluid from the pipeline.

13. A pipeline processing assembly according to claim 13, and comprising a holding tank connected to the exit opening of the pipeline and communicating with said vacuum source for receiving the fluid exiting the pipeline as said vacuum source absorbs the air block to free downstream movement of said pig.

* * * * *